US007036275B2

(12) United States Patent
Quesada

(10) Patent No.: US 7,036,275 B2
(45) Date of Patent: May 2, 2006

(54) HUNG WINDOW CARRIER SYSTEM AND METHOD

(76) Inventor: Flavio Quesada, c/o CGI, 7840 NW. 62nd St., Miami, FL (US) 33166

( * ) Notice: Subject to any disclaimer, the term of this patent is extended or adjusted under 35 U.S.C. 154(b) by 212 days.

(21) Appl. No.: 10/714,940

(22) Filed: Nov. 18, 2003

(65) Prior Publication Data

US 2005/0102907 A1 May 19, 2005

(51) Int. Cl.
*E05F 1/00* (2006.01)
*E06B 3/00* (2006.01)

(52) U.S. Cl. ..... 49/446; 49/449; 49/503

(58) Field of Classification Search ..... 49/446, 49/449, 453, 503, 450, 451, 445, 181, 183; 16/193, 197, 200; 292/32, 33, 42, 137, 138, 292/145, 148, 150, 95, 102, DIG. 20, DIG. 47
See application file for complete search history.

(56) References Cited

U.S. PATENT DOCUMENTS

| | | | | | |
|---|---|---|---|---|---|
| 2,791,795 | A | * | 5/1957 | Haas | 16/197 |
| 2,796,630 | A | * | 6/1957 | Haas | 49/446 |
| 3,206,795 | A | * | 9/1965 | Weidner | 16/197 |
| 3,233,278 | A | * | 2/1966 | Lundgren | 16/197 |
| 3,482,354 | A | * | 12/1969 | Trout | 49/181 |
| 3,498,000 | A | | 3/1970 | Nobes | |
| RE27,135 | E | | 6/1971 | Dinsmore | |
| 3,688,441 | A | | 9/1972 | Rackard | |
| 3,706,467 | A | * | 12/1972 | Martin | 292/DIG. 20 |
| 4,799,333 | A | | 1/1989 | Westfall | |
| 4,885,871 | A | * | 12/1989 | Westfall et al. | 49/446 |
| 4,914,861 | A | * | 4/1990 | May | 49/181 |
| 5,027,557 | A | * | 7/1991 | May | 49/181 |
| 5,189,838 | A | * | 3/1993 | Westfall | 49/181 |
| 5,231,795 | A | | 8/1993 | Westfall | |
| 5,414,962 | A | | 5/1995 | Forbis et al. | |
| 5,572,828 | A | * | 11/1996 | Westfall | 49/181 |
| 6,857,228 | B1 | * | 2/2005 | Kunz et al. | 49/181 |
| 6,892,494 | B1 | * | 5/2005 | Malek | 49/181 |

FOREIGN PATENT DOCUMENTS

CA 2229252 C * 4/2002

OTHER PUBLICATIONS

"Ultralift Takeout System II", Caldwell Manufacturing company, Sep. 28, 2000.

* cited by examiner

*Primary Examiner*—Hugh B. Thompson, II
(74) *Attorney, Agent, or Firm*—Greenblum & Bernstein, P.L.C.

(57) ABSTRACT

A hung window carrier system and method is provided. The system includes a jamb having a pair of tracks. Also included is a sash clip to be affixed to a window sash, a carrier having a slidable portion and a window sash support portion, wherein the window sash support portion removably engages the sash clip and supports the window sash. The slidable portion slides along the jamb, and the carrier is connectable to a balance. A locking mechanism includes a jamb lock located on the jamb and a carrier lock located on the carrier, the jamb and carrier locks are configured to align with each other by sliding the carrier within the jamb. After the jamb lock and carrier lock are aligned, the locking mechanism may be used to lock the carrier in place along the jamb such that the carrier cannot move in either an upper or lower direction.

22 Claims, 13 Drawing Sheets

HUNG WINDOW CARRIER SYSTEM AND METHOD

BACKGROUND OF THE INVENTION

1. Field of the Invention

The present invention is related to a carrier system and method for hung windows, and more particularly relates to an carrier system and method for easy removal of hung windows from a captured jamb.

2. Background and Material Information

Captured jamb-type hung windows are known in the art for being useful in impact-resistant window applications, in areas of high winds and the like, whereas non-captured jamb designs (primarily used in tilting window systems) are generally too weak for applications in areas of high winds. In such captured-jamb systems, the jamb has a generally U-shaped cross-sectional configuration to prevent the window sash from being dislodged from the jamb during high winds or other impact. One such captured jamb design is disclosed in the "Ultralift Takeout System II" manufactured by Caldwell Manufacturing Company, of Rochester, N.Y. (the "Caldwell System").

In the Caldwell System, a carrier 21B81 supports a bracket assembly 21B72, the latter which is screwed to a window sash, and the window may slide along guide rails of the window jamb. The carrier is attached to an ultra-lift balance, and has a swingable hook portion that is engageable with a 45° lance. To remove the window of the Caldwell System, the user must remove sash plate 21B88, 21B89 from the bottom of the sash to access the swingable hook portion of the carrier. The user then reaches into the jamb area and pivots the hook, and then slides the window until the swingable hook portion of the carrier engages the lance, thereby securing the carrier in place. Once the carrier is secured in place, the window may be lifted to disengage the bracket assembly from the carrier, so that the window can be removed.

Caldwell discloses a rather complicated and expensive system, and requires a significant amount time to remove the window sash, since, e.g., the sash must first be unscrewed. Also, since the user must reach up into the jamb area to lock the carrier to the jamb, the user may injure his or her fingers. Additionally, once the swingable hook portion engages the lance, the carrier is secured against movement in only one direction, i.e., the upward direction, as the carrier is upwardly biased by the spring of the balance. In the event that the balance is disengaged from the carrier while the carrier is secured (either intentionally or accidentally), the carrier is no longer upwardly biased and may then come crashing down, potentially damaging the window and/or injuring the user. Further, because the carrier must be able to slide over the lance, the carrier must be formed in a "W" configuration, adding to manufacturing complexity and cost.

Additionally, U.S. Pat. No. 3,498,000 to NOBES discloses a takeout apparatus for aluminum window sash 12, the apparatus having a carrier 20 that slides along a window jamb or frame 11. The sash has a sash clip 25 that engages a carrier 20, the latter having extensions 21 that engage a retainer spring 29 attached to the frame. As described in col. 4, lines 43–55, to remove the window sash from the frame, the sash must be raised to its upper limit of travel to allow the carrier extensions 21 to engage the spring, thereby locking the sash in position. Once locked, the sash clip 25 may be disengaged from the carrier 20, and the sash may then be removed from the frame 11.

However, there are several disadvantages to NOBES. For example, since the sash must be raised to its upper limit of travel, where the retainer spring 29 is located, the range of opening of the window is reduced. Additionally, removing the window sash when it is at its uppermost limit of travel creates the unnecessary hazard of lifting a heavy window sash from such a high location.

SUMMARY OF THE INVENTION

In view of the above inadequacies of the prior art, the present invention provides a carrier system for hung windows that allows a window sash to be easily and quickly removed from a window jamb, and that is economical to manufacture. The carrier system is also configured such that a carrier is lockable in place in both vertical (i.e., both upper and lower) moving directions (i.e. both directions of an axial direction). Additionally, the carrier of the present invention is not limited to being locked at an uppermost limit of travel, but may be locked at virtually any location along the length of the window jamb, and at a plurality of different locations along the jamb.

The present invention has the benefits of being used in a captured-jamb design while allowing the sash to be easily removed from the jamb, without first having to disengage the balance. Also, the present invention provides the flexibility of allowing a variety of spiral or block and tackle tilt balances to be used therewith, and further provides ease of interchangability between these types of balances. Since in the present invention the window balance is attachable to the carrier, rather than directly to the sash, the balance may be more safely and easily accessed and/or replaced, because the sash may be removed from the jamb. Additionally, the carrier does not interfere with balance installation screws, which would otherwise be problematic especially when using block and tackle balances, which slide with the sash.

The hung window carrier system includes a jamb having a generally U-shaped cross section having a back portion and two opposed side portions, the jamb comprising a pair of tracks, each track located on a respective side portion and extending in an axial direction substantially parallel to the jamb, the jamb having a pair of opposed channel portions defined by the back portions, respective opposed side portions, and respective pair of tracks. The invention also includes a sash clip configured to be affixed to a window sash, a carrier having a slidable portion and a window sash support portion, wherein the window sash support portion is configured to removably engage the sash clip and further configured to support the window sash. The slidable portion is configured to slide along the jamb toward upper and lower extremities in the axial direction between the back portion and the opposed side portions, and the carrier is configured to be connected to a window balance. The invention also has a locking mechanism comprising a jamb lock located on the jamb and a carrier lock located on the carrier, the jamb lock and carrier lock configured to align with each other by sliding the carrier within the jamb, wherein after the jamb lock and carrier lock are aligned, the locking mechanism is configured to lock the carrier in place along the jamb such that the carrier cannot move toward either the upper or lower extremities.

The jamb may further include an aperture located on the jamb where the plurality of tracks are not present, wherein the carrier is insertable into and removable from the aperture in a direction at least one of oblique and perpendicular to the axial direction. Also, the aperture may be located proximate the upper extremity of the jamb, and the slidable portion may include a first width less than a distance between the two opposed side portions, and a second width greater than a distance between the two opposed side portions.

The slidable portion may further include a first width less than a distance between the two opposed side portions, and a second width greater than a distance between the two opposed side portions, the second width being insertable into and removable from the aperture.

The system may also include a pair of side guides, each having a generally U-shaped cross section and affixed to a respective opposed edge of the slidable portion of the carrier and configured to slide, together with the carrier, within the channel portion in the axial direction.

The jamb lock may yet include a plurality of jamb locks arranged in the axial direction. The carrier lock may include a carrier clip, and the plurality of jamb locks may include a respective plurality of jamb recesses each configured to accept the carrier clip.

Also, the carrier lock may include a carrier aperture and a carrier pin, the plurality of jamb locks may include a respective plurality of jamb recesses, and the carrier pin may pass through the carrier aperture to be inserted into a jamb recess of the plurality of jamb recesses. Also, the slidable portion may be substantially planar.

The carrier lock may be located on the slidable portion at a position axially below the window sash, when the window sash support portion supports the window sash, thereby making it easier for a user to access the carrier lock, and further reducing the possibility of a user injuring his or her fingers, since the user does not have to insert his or her fingers up into the region between the window sash and carrier.

Also provided is a method of removing a hung window sash from a jamb of a window frame, the jamb having a jamb having a generally U-shaped cross section, the generally U-shaped cross section having a back portion and two opposed side portions, the jamb further having a pair of tracks, each track of the plurality of tracks located on a respective side portion and extending in an axial direction substantially parallel to the jamb, the window having a sash clip affixed to a window sash. The method includes supporting the window sash by a window sash support portion of a carrier engaged with the sash clip, sliding the carrier via a slidable portion thereof, the slidable portion located between the back portion and the opposed side portions, along the jamb in the axial direction, aligning a carrier lock located on the carrier with a jamb lock located on the jamb, locking the carrier against movement toward an upper and lower extremity of the axial direction relative to the jamb, by engaging the carrier lock with the jamb lock. The method further includes lifting the window sash substantially in the axial direction to disengage the sash clip from the window sash support portion, laterally moving the window sash in a direction substantially parallel to a plane defined by the window frame, pivoting the window sash about an axis substantially parallel to the axial direction, and removing the window sash from the jamb.

The jamb may also include an aperture located on the jamb where the plurality of tracks are not present, and the method may also include at least one of inserting and removing the carrier from the aperture in a direction at least one of oblique and perpendicular to the axial direction.

Also, the aperture may be present proximate a top of the jamb, and the slidable portion may include a first width less than a distance between the two opposed side portions, and a second width greater than a distance between the two opposed side portions. Also, the second width may be insertable into and removable from the aperture.

The jamb may further have a pair of generally U-shaped side guides respectively located between the pair of opposed side portions and the back portion, and the method may further include sliding the carrier by the slidable portion in the pair of generally U-shaped side guides.

The jamb lock may include a plurality of jamb locks arranged in the axial direction, and the carrier lock may include a carrier clip. The plurality of jamb locks may include a respective plurality of jamb recesses, and the locking may further include inserting the carrier clip into one of the plurality of jamb recesses. Also, the carrier lock may include a carrier aperture and a carrier pin, the plurality of jamb locks may include a respective plurality of jamb recesses, and the locking may further include passing the carrier pin through the carrier aperture and into a jamb recess of the plurality of jamb recesses.

The carrier lock may be located on the slidable portion at a position axially below the window sash, when the window sash support portion supports the window sash. Also, the slidable portion may be substantially planar.

Also provided is a method of inserting a hung window into a jamb, the jamb having a generally U-shaped cross section, the generally U-shaped cross section having a back portion and two opposed side portions, the jamb further having a pair of tracks, each track of the plurality of tracks located on a respective side portion and extending in an axial direction substantially parallel to the jamb, the window having a sash clip affixed to a window sash. The method includes inserting an edge of the window sash into the jamb, the edge substantially parallel to the axial direction, pivoting the edge of window sash about an axis substantially parallel to the axial direction until a plane defined by the window sash is substantially parallel with a plane defined by the jamb, laterally moving the window sash along the plane defined by the window sash, lowering the window sash substantially in the axial direction to engage the sash clip with a window sash support portion of a carrier, and unlocking the carrier in the axial direction relative to the jamb by disengaging a carrier lock from a jamb lock, such that a slidable portion of the carrier may slide along the jamb in the axial direction, the slidable portion located between the back portion and the opposed side portions.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of preferred embodiments of the present invention, in which like numerals represent like elements throughout the several views of the drawings, and wherein.

DETAILED DESCRIPTION OF THE PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
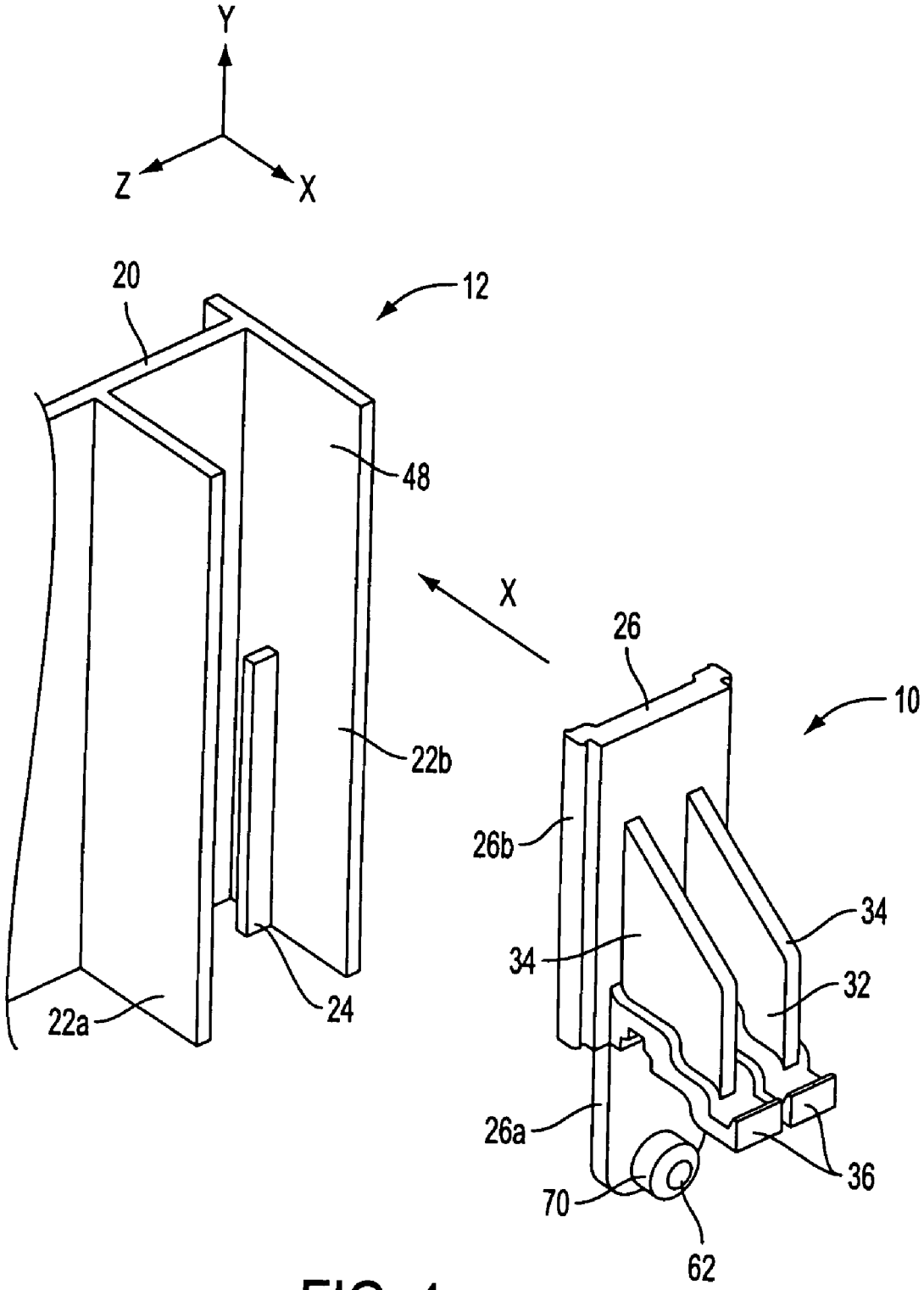
FIG. 1 is a perspective exploded view of the carrier and jamb according to the present invention.
Figure 2:
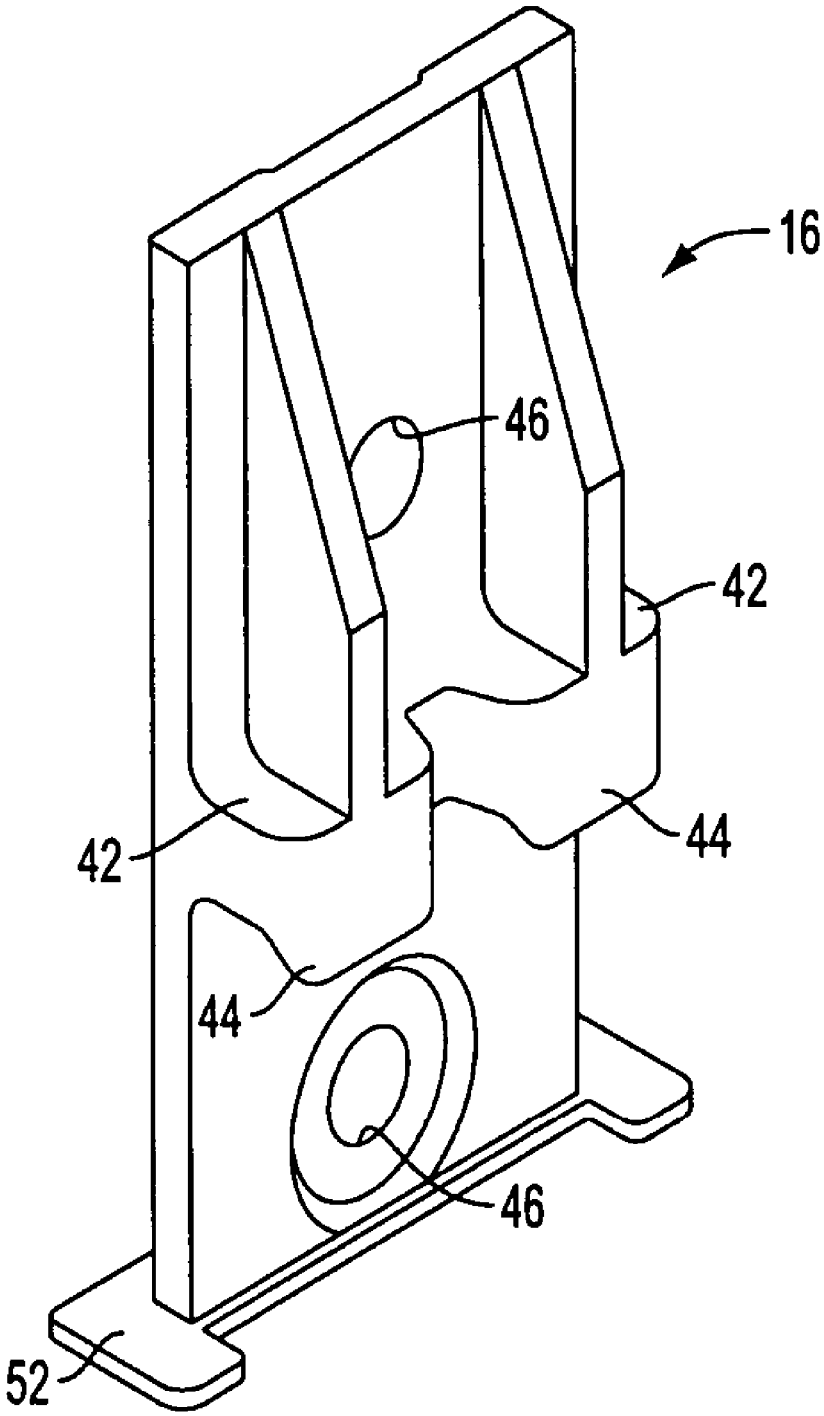
FIG. 2 is a perspective view of the sash clip according to the present invention.

Referring to the drawings wherein like numerals represent like elements, FIG. 1 shows a carrier 10 and a jamb 12 in which the carrier slides. The jamb 12 has a generally U-shaped cross-sectional configuration, as can also be seen in FIG. 5, and may be affixed to, integral with or unitary with a window frame 14 (shown in FIG. 8). FIG. 2 shows a sash clip 16 which may be affixed to, integral with or unitary with a side rail 50 of a window sash 18 (shown in FIG. 6) via screws (not shown) inserted through holes 46 and penetrating into the window sash. However, it is understood by those skilled in the art that the sash clip 16 may be affixed to the window sash by other known means. The present invention includes the jamb 12, carrier 10 and sash clip 16, and in the preferred embodiment, there is a jamb 12, a carrier 10 and sash clip 16 each at opposite sides of the window frame 14.

The jamb 12 has a back portion 20 and two opposed side portions 22*a*, 22*b* which form the generally U-shaped cross section. The jamb 12 also has a pair of tracks 24 (only one of which is visible in FIG. 1), each affixed to a respective side portion 22*a*, 22*b*, that run substantially parallel to the jamb 12, and create opposed channel portions 30 in the jamb. The carrier 10 has a generally planar slidable portion 26 configured to slide along the jamb 12 within the channel portions 30, as shown in FIG. 5.

As shown in FIG. 1, the jamb 12 also has a region (aperture) 48, preferably at the top of the jamb, where there are no tracks 24 present therein, and the slidable portion 26 has a lower portion 26*a* and an upper portion 26*b*. The lower portion 26*a* has a width less then the distance between the tracks 24, and the upper portion 26*b* has a width greater than a distance between the tracks but less than the distance between the side portions 22*a*, 22*b* of the jamb 12. With such a configuration, the aperture 48 does not extend the entire length of the carrier 10, but rather merely extends the length of the upper portion, thereby allowing the upper portion 26*b* to be captured by the opposed channel portions 30 of the jamb 12, while giving the carrier a longer range of travel along the jamb than would otherwise be available if the aperture extended the entire length of the carrier. Thus, as shown in FIG. 1, the carrier may be inserted into the jamb in a direction generally parallel to the illustrated X-axis direction, since the upper portion 26*b* passes through the aperture, and the lower portion 26*a* passes between the tracks 24. While the aperture 48 is preferably located at the top of the jamb 12 since it is the most unlikely location where the sash 18 (and associated sash clip 16 and carrier 10) would be positioned when the invention is being used, it will, however, be understood by those skilled in the art that the aperture 48 may alternatively be located, e.g., at the bottom of the jamb, wherein the upper portion has a width less then the distance between the tracks 24, and the lower portion has a width greater than a distance between the tracks but less than the distance between the side portions of the jamb.

Figure 5:
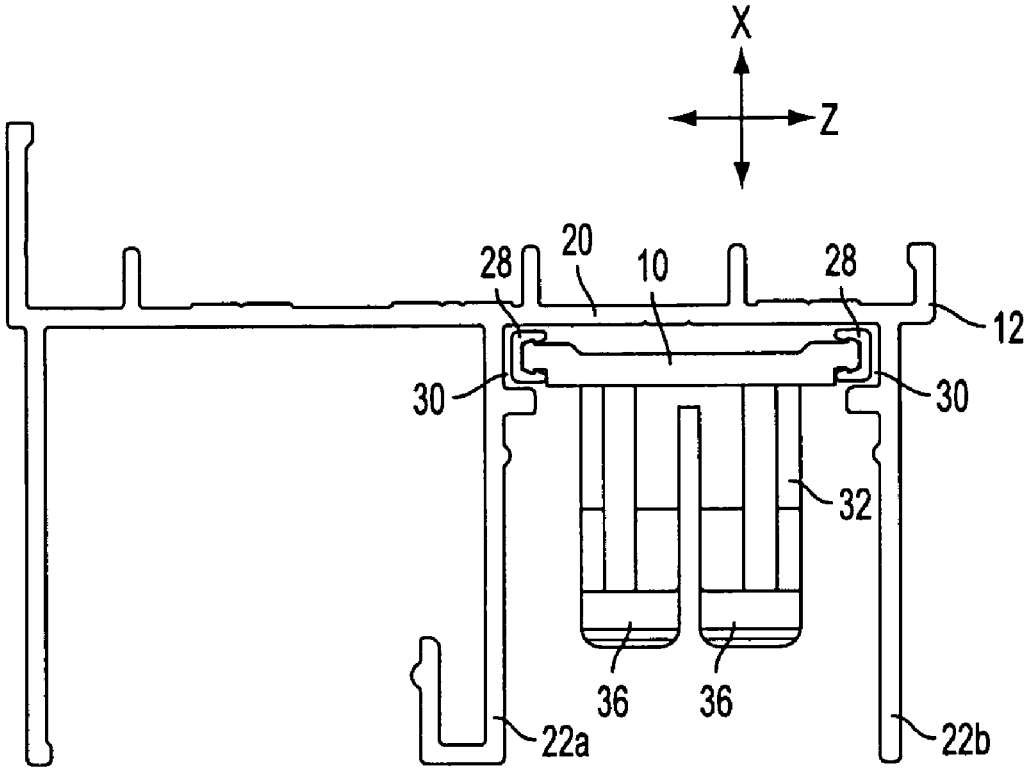
FIG. 5 is a top plan schematic view of the carrier inserted into the jamb.

As shown in FIG. 5, a pair of side guides 28 each having a generally U-shaped cross section are snapped, clipped or otherwise affixed to opposed edges of the upper portion 26*b* of the slidable portion 26 of the carrier 10 (i.e., affixed to the edges of the slidable portion that extend generally parallel to the jamb 12). The side guides 28 are preferably made from nylon or other low-friction material to enable the carrier 10 (which is preferably made of die-cast zinc, but may be made of other strong materials, such as aluminum, steel, glass-reinforced nylon and the like, in other embodiments) to slide freely within the jamb 12 without substantially moving in the illustrated Z-axis direction.

Figure 3:
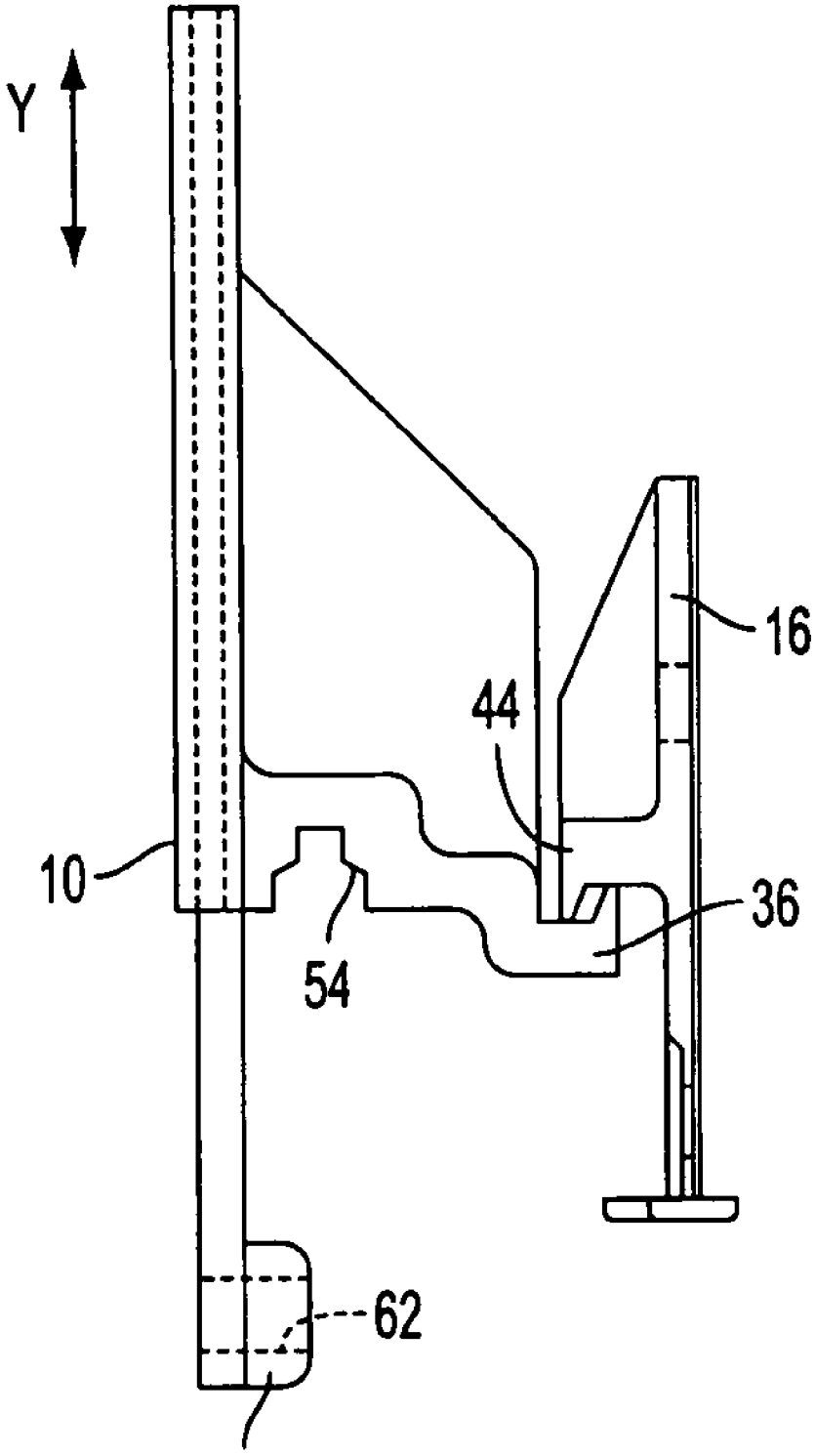
FIG. 3 is a side schematic view of the carrier and sash clip engaged with each other.
Figure 4:
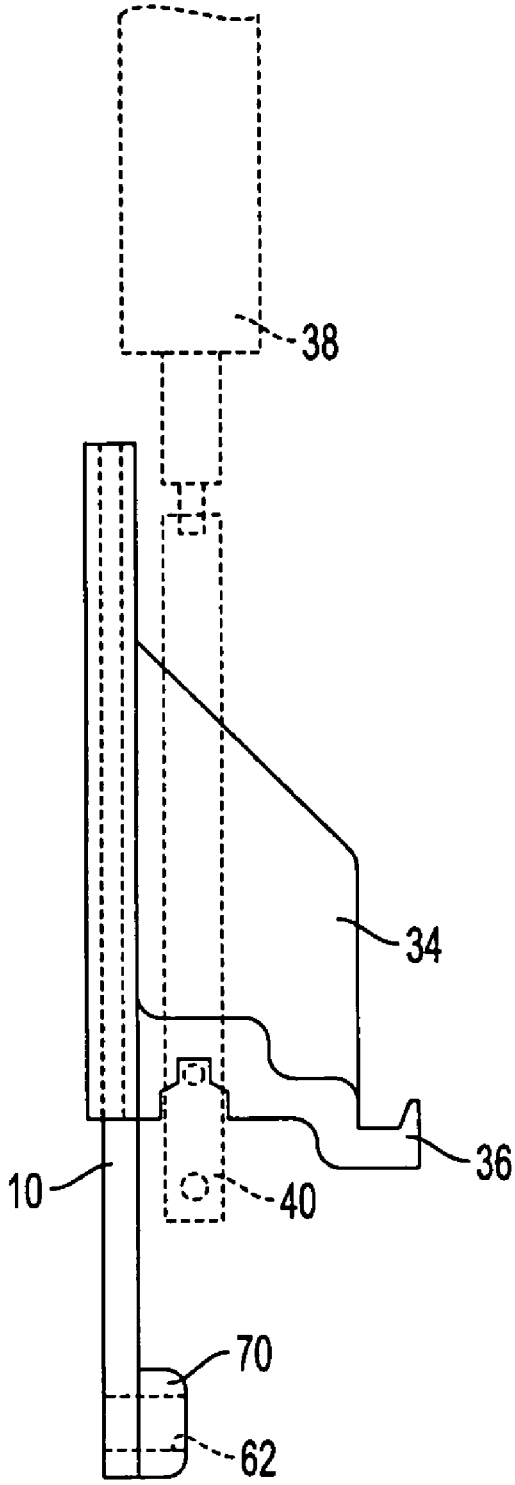
FIG. 4 is a side schematic view of the carrier with a balance attached thereto.

The carrier 10 also has a window sash support portion 32 having a pair of prongs 34 extending from the slidable portion 26, each prong 34 having a hook portion 36 at the distal end thereof. As shown in FIG. 4, a balance 38 (shown in hatched lines) is secured to the carrier 20 by inserting the balance between the prongs 34. The other end of the balance (not shown) is affixed to the window frame 14. The balance 38 exerts a biasing force in the upward direction (i.e. toward the top of the sheet of FIG. 4), and a nut, pin or enlarged section 40 is affixed to the distal end of the balance to prevent disengagement of the carrier 10 and balance. The enlarged section has a diameter larger than the distance between the prongs 34, thereby biasing the carrier in the upward direction. To facilitate the connection of the balance 38 to the carrier 10, the window sash support portion 32 of the carrier has a recess 54 (shown in FIG. 3) configured to capture the enlarged section 40 therein, to prevent the sliding of the enlarged section along the length of the carrier prongs 34. It is noted that while the balance 38 shown in FIG. 4 is a spiral-type balance, it is readily apparent to those skilled in the art that block-and- tackle tilt-type balances, as well as other types of balances may be used in conjunction with the present invention. Such a configuration is advantageous over the prior in that it allows at least either spiral or block-and-tackle tilt type balances to be used in the carrier without substantial modifications thereto.

The sash clip 16, which is affixed to, integral with or unitary with the window sash 18, has a pair of prongs 42 extending from the sash clip, each prong having a hook portion 44 at the distal end thereof. As shown in FIG. 3, the sash clip hook portions 44 removably engage the carrier hook portions 36 such that the sash clip 16 is supported by the carrier 10.

Figure 6:
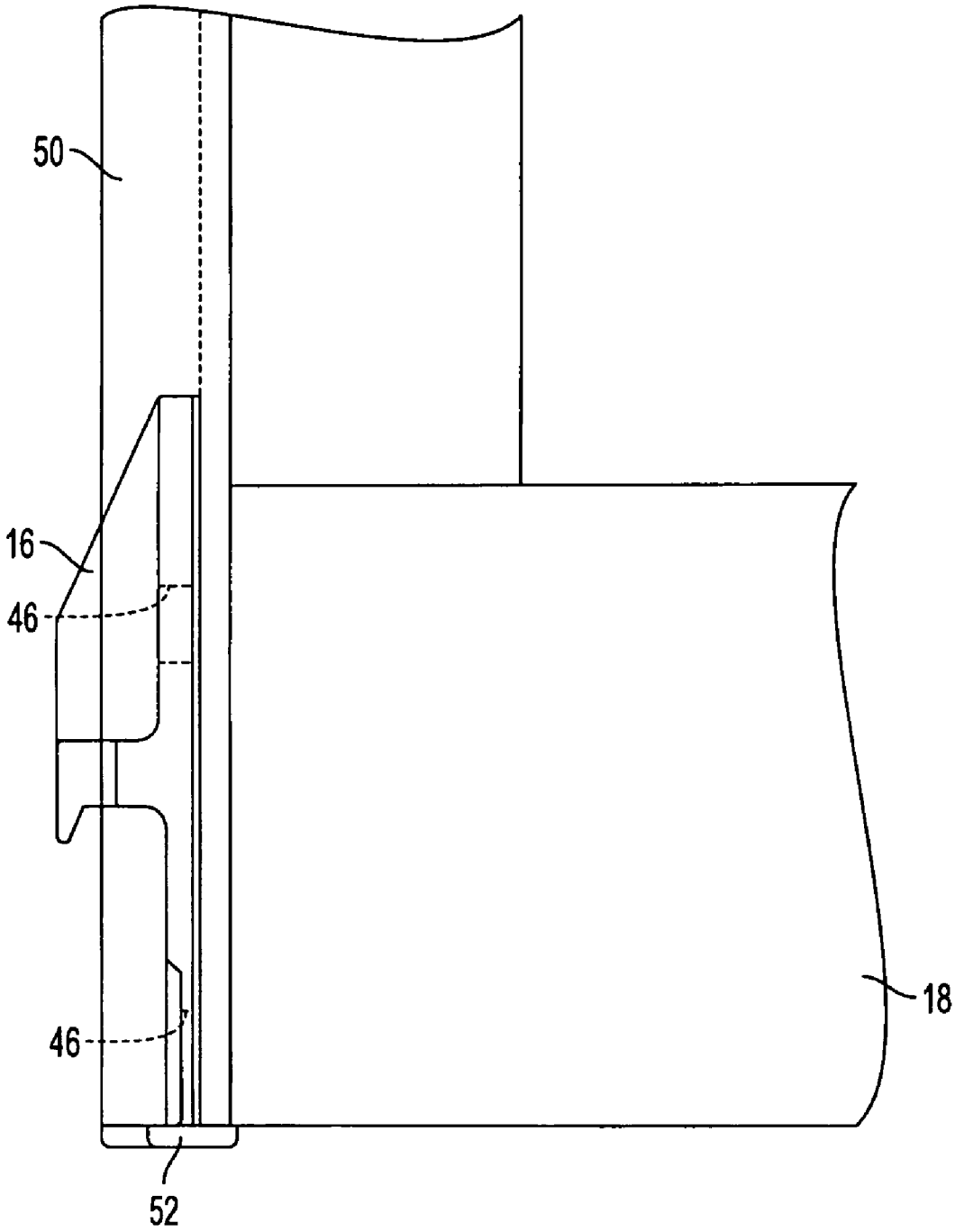
FIG. 6 is a side schematic view of the sash clip affixed to a window sash.

The sash clip prongs 42 and the carrier prongs 34 each are tapered such that the proximal end thereof is larger in size than the distal end (i.e., where the hooks portions 36, 44 are located). Such a tapered configuration provides added strength to the prongs 34, 42 of the respective carrier 10 and sash clip 16 to support the weight of the window sash 18 when the window sash is mounted in the window frame 14. Also, the tapered configuration of the carrier prongs 34 allows the window sash 18 to be centered in the window frame 14 when the sash clips 16 are lowered on the carrier 10 during installation of the window sash. The tapered configuration of the sash clip prongs 42, in addition to strengthening the sash clip, also serve to guide the sash clip hook portions 36 over the carrier prongs, should the sash clip prongs be mistakenly inserted under the carrier prongs 34. Further, during an installation process of the window sash 18 in the window frame 14, the sash clip prongs 42 are allowed to straddle the balance 38, thereby allowing the side rails 50 of the window sash to be inserted even further into the jamb 12 and making the installation process easier. The sash clip 16 also has a foot portion 52 at the bottom thereof, which is affixed below the bottom of the window sash 18 (as shown in FIG. 6), to help support the window sash from below when the sash clip is engaged with the carrier 10 (e.g., when the window sash is mounted in the window frame 14), and to help prevent the sash clip from becoming disengaged from the window sash.

Figure 7A:
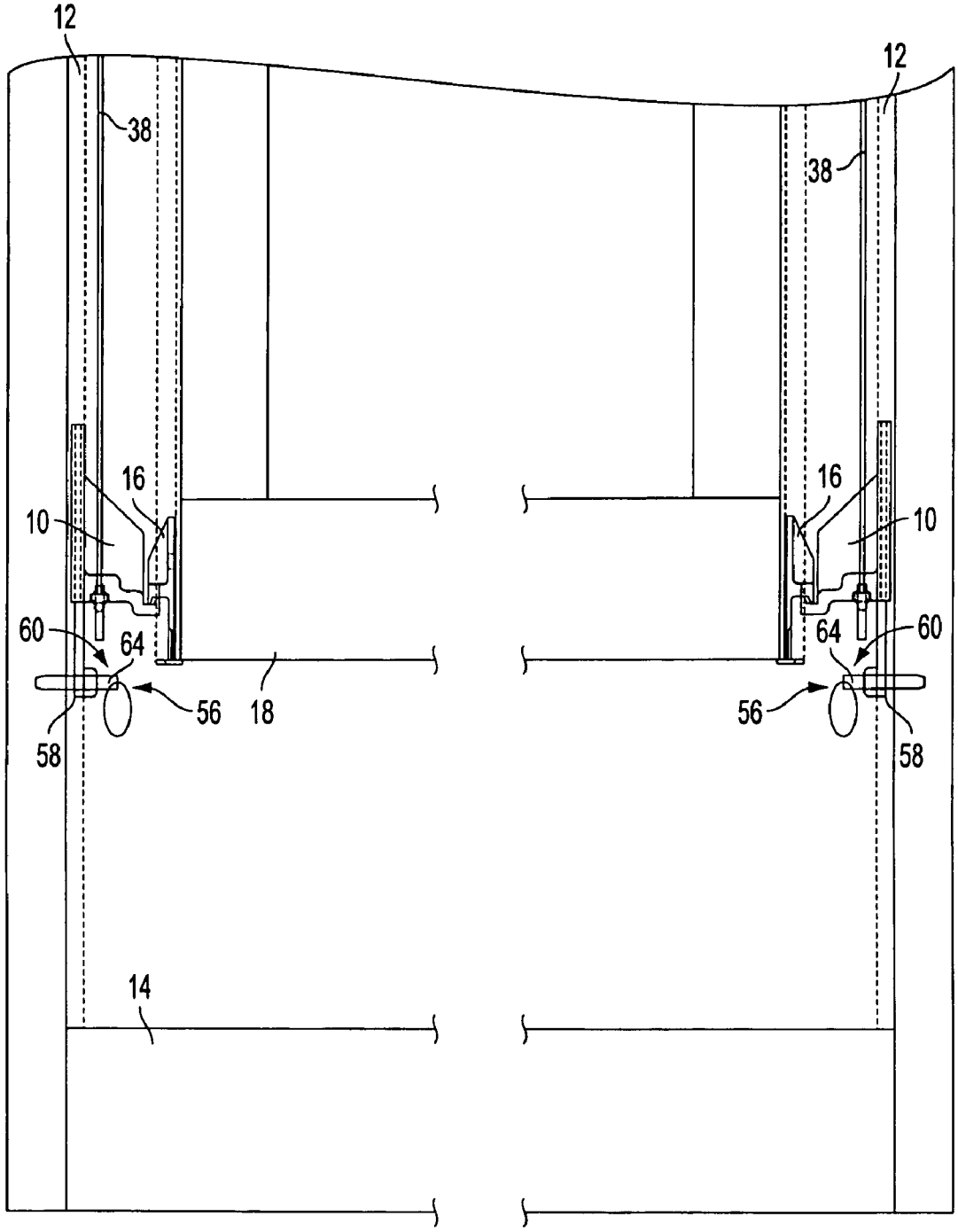
FIG. 7A is a schematic partial view of a window with the carrier in locked position, with the carrier and sash clip engaged with each other.

Thus, when the carrier 10 is in the jamb 12, and when the sash clip is engaged with the carrier when the window sash 18 is mounted in the window frame 14, the carrier (and window sash) may freely slide up and down in axial direction Y (with reference to, e.g., FIGS. 1 and 3) within the jamb when a user respectively raised and lowers the window sash. Referring to FIG. 7A, the present invention also allows the carrier 10 to be fixed in position to prevent the carrier (and window sash 18) from sliding up and down in the axial direction Y, by a locking mechanism 56. The locking mechanism includes a jamb recess (jamb lock) 58 located in the jamb, and a carrier lock 60. In the figures, the carrier lock 60 includes a carrier aperture 62 located in the lower portion 26*a*, and also includes a carrier pin 64. While only one jamb recess is shown in FIG. 7A, it is readily appreciable by those skilled in the art that a plurality of jamb recesses 58 may be located in the jamb along the Y direction, thereby allowing the carrier to be locked at any position along the jamb where a jamb recess is located.

Figure 7B:
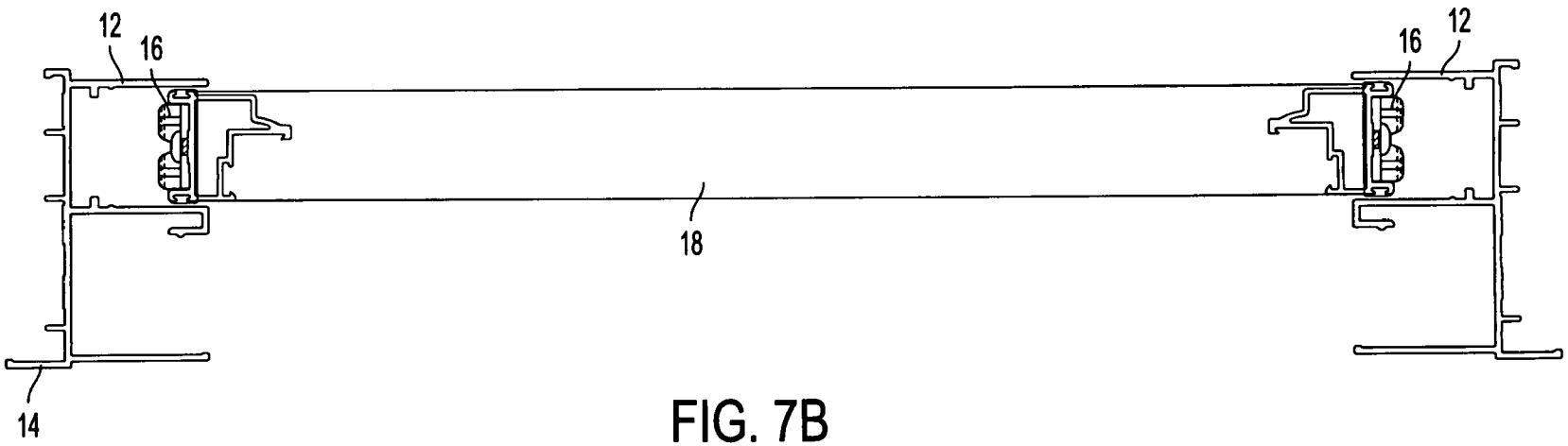
FIG. 7B is a sectional top plan schematic view of the window sash installed in the jamb of FIG. 7A.
Figure 11:
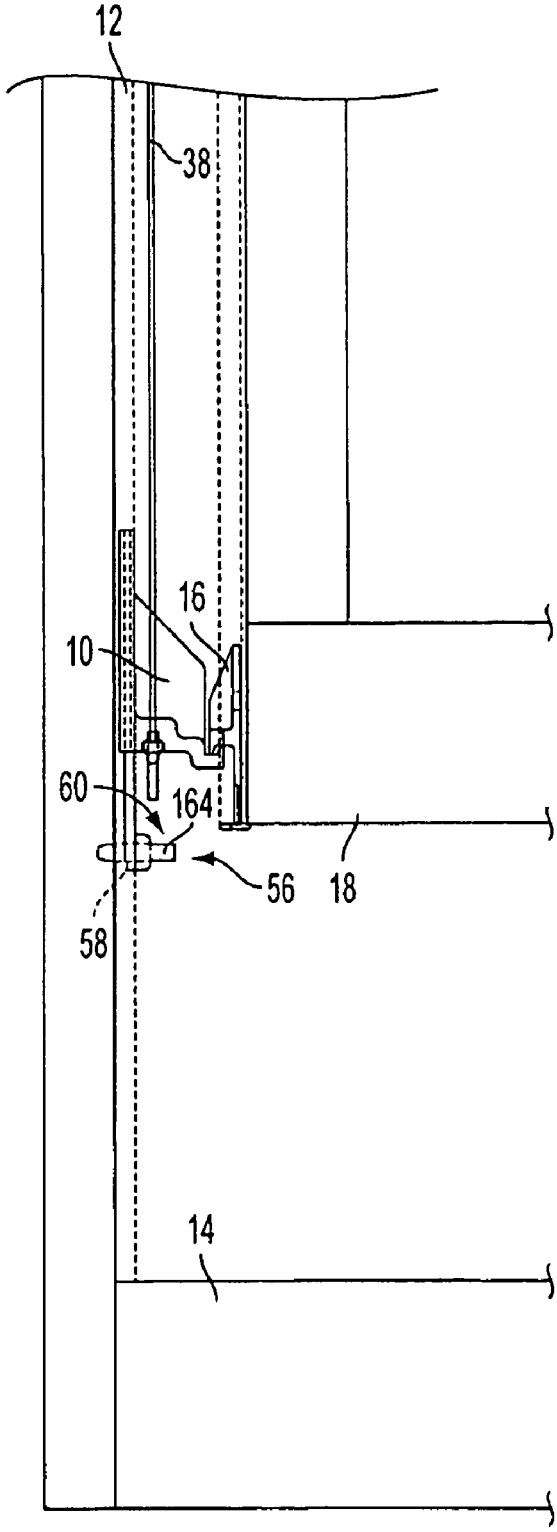
FIG. 11 is a schematic partial view of a window with the carrier in locked position, with the carrier and sash clip disengaged from each other, and with the window sash moved laterally toward one jamb, according to another embodiment of the present invention.

To lock the carrier 10 in place, the carrier (and window sash 18) is moved along the jamb 12 such that the carrier aperture 62 aligns in registry with the jamb recess 58. Once aligned, the carrier pin 64 is inserted through the carrier aperture 62 into the jamb recess 58, thereby securing the carrier 10 (and window sash 18), preventing the carrier 10 (and window sash 18) from up and down movement in the axial direction Y. The carrier aperture 62 is surrounded by a reinforcement ring 70 (preferably integral with the carrier) to provide added support to the carrier when the carrier pin 64 is inserted into the carrier aperture 62. Additionally, the carrier pin 64 can be detachably stored on the carrier 10, while the window sash is in a movable position (i.e., when the carrier is not in the locked position) to prevent the loss thereof. A ring 66 located on an end of the carrier pin 64 may be used for this purpose, or in alternative embodiments, a clip or other receptacle may be mounted on the carrier 10 for holding the carrier pin 54. In the embodiment shown in the figures, the a jamb recess 58 , carrier aperture 62 and carrier pin 64 make up the locking mechanism, although those skilled in the art will readily appreciate that in alternative embodiments, other types of locking mechanisms may be used. For example, rather than a jamb recess 58, a boss, slot, channel and the like may be used in the jamb, and rather than a carrier pin 64 and carrier aperture 62, a built-in clip 164 (shown schematically in FIG. 11), spring-loaded pin, button or other removably protruding mechanism may be part of the carrier 10 to complementarily and removably engage at least one of the boss, slot, channel and the like of the jamb 12, and thereby lock the carrier 10 in place. As shown in FIG. 7B, in both the locked position and the movable position, the edges of the window sash 18 are each captured in a respective jamb 12. It is noted that in FIG. 7B is a sectional top plan view showing the window sash 18, sash clip 16 and jamb 12; however, other details such as, e.g., the carrier 10 and window glass are not shown for ease of understanding.

Figure 8:
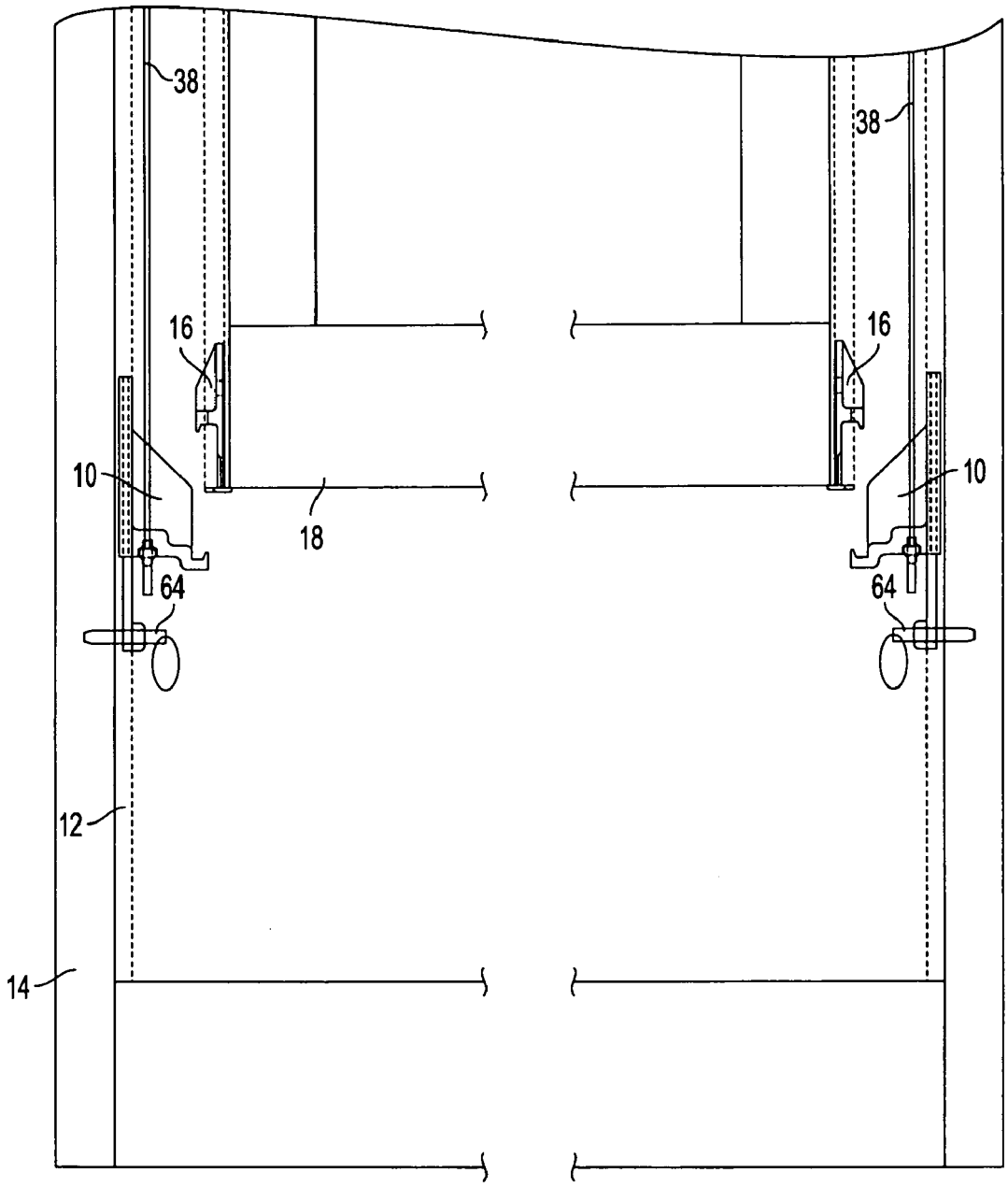
FIG. 8 is a schematic partial view of a window with the carrier in locked position, with the carrier and sash clip disengaged from each other.
Figure 9A:
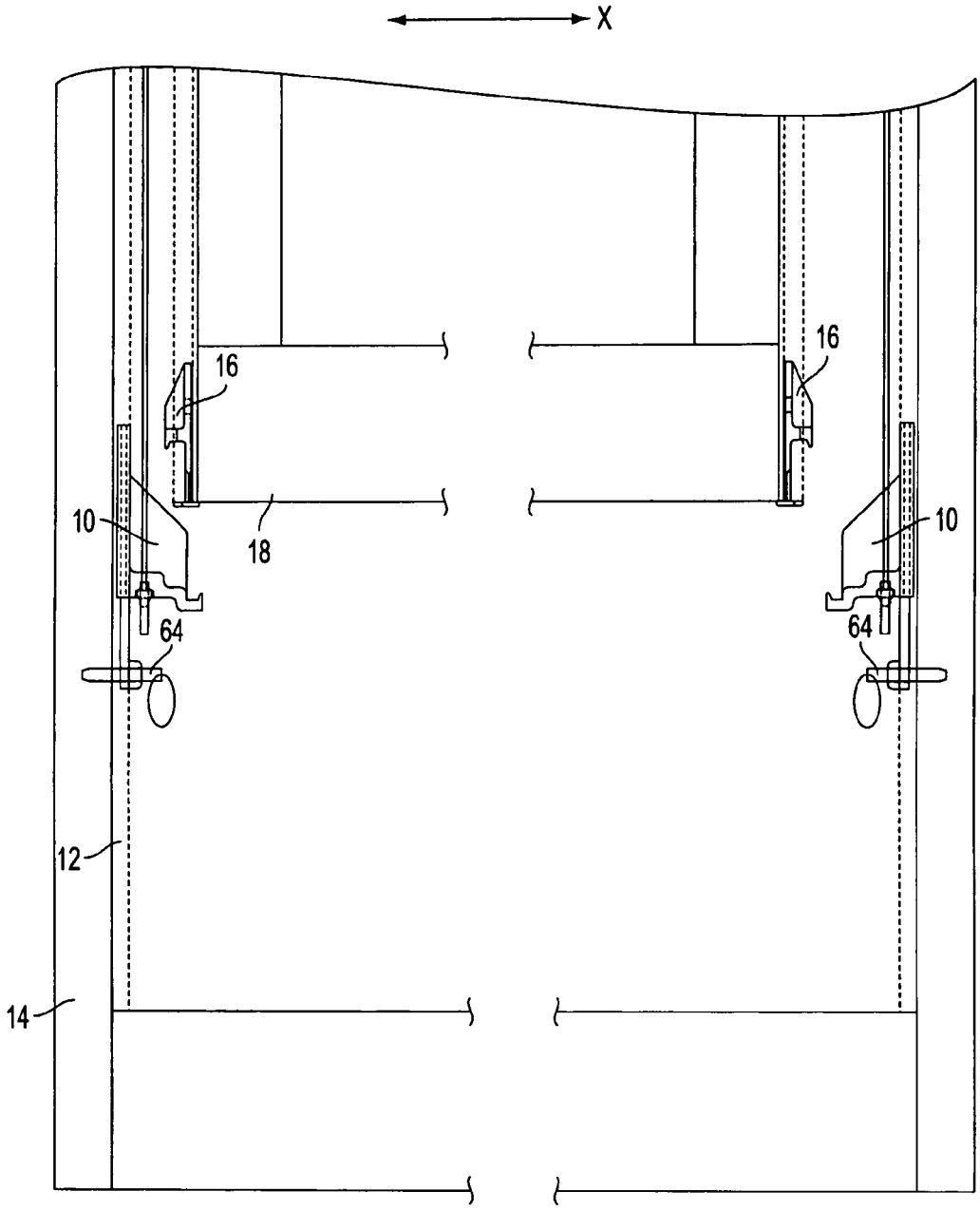
FIG. 9A is a schematic partial view of a window with the carrier in locked position, with the carrier and sash clip disengaged from each other, and with the window sash moved laterally toward one jamb.
Figure 9B:
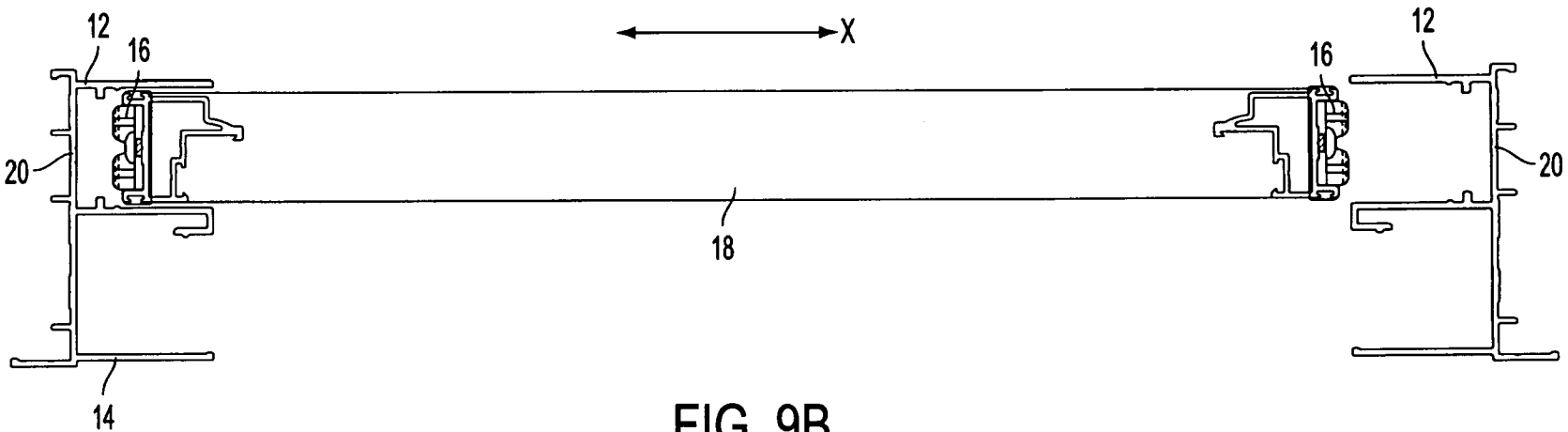
FIG. 9B is a sectional top plan schematic view of the window sash moved laterally toward the jamb of FIG. 9A.

To remove the sash 18 from the window jamb 12, once the carrier 10 is locked in place and secured against movement in the Y direction, as discussed supra and shown in FIG. 7A, the sash 18 is then lifted substantially in the Y direction to disengage the sash clip 16 from the carrier, such that the carrier no longer supports the window sash, as shown in FIG. 8. Once the sash 18 is disengaged, the sash is then moved laterally along the X axis direction toward the back portion 20 of one of the jambs 12, such that one edge of the sash (on the left side of FIGS. 9A and 9B) further protrudes into the jamb, and such that another edge of the sash (on the right side of FIGS. 9A and 9B) is no longer captured by the jamb, as shown in FIGS. 9A and 9B. Although FIGS. 9A and 9B show an edge of the sash 18 being moved toward the back portion 20 of the jamb 12 on the left side of the figures, the present invention is configured such that the sash may alternatively be moved toward the back portion of the jamb on the right side of the figures, i.e., the sash may be moved toward the back portion of either jamb 12 of the window frame 14. Thereafter, the sash 18 is pivoted substantially about the Y axis direction at the edge of sash that remains captured by the jamb 12, such that the edge of the sash that is no longer captured by the jamb, is no longer facing the back portion 20 of the jamb, i.e. the sash is no longer parallel to the X axis direction (i.e. a plane defined by the window frame 14). At this point, the sash 18 may be completely removed from the jamb by moving the sash in the direction of the sash edge that is no longer captured by the jamb is facing.

Figure 10:
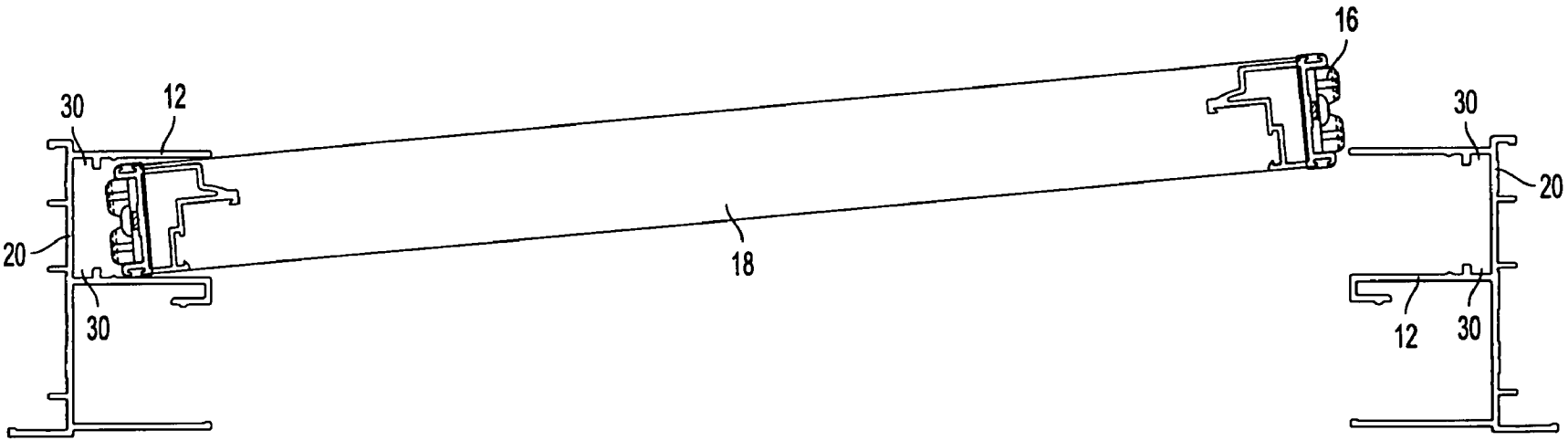
FIG. 10 is a sectional top plan schematic view of the window sash in a pivoted position.

To insert the sash 18 into the jamb 12, the above procedure may be performed in reverse. Specifically, after the carrier 10 is secured in place as described supra, an edge of the sash 18 is inserted towards the back portion 20 of the jamb 12 (as shown in FIG. 10), whereupon the sash may be pivoted such that it is substantially parallel with the X axis direction (as shown in FIG. 9B). Thereafter, the sash is lowered such that the sash clip 16 is lowered onto and supported by the carrier 10 and the sash clip hook portions 44 engage the carrier hook portions 36. To facilitate the centering of the sash 18 during the lowering process, as discussed supra, the tapered configuration of the carrier prongs 34 allows the sash 18 to slide downward and laterally (i.e., toward the center of the frame) due to the engagement of the foot portion 52 of the sash clip 16 with the tapered portion of the carrier prongs 34, as can be seen in FIGS. 2, 3 and 7A. Once the sash clip 16 (and sash connected thereto) is securely supported by the carrier 10, the carrier pin 64 may be removed from the carrier, whereupon the sash may freely slide up and down within the jamb 12.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A hung window carrier system comprising:

a jamb having a generally U-shaped cross section, said generally U-shaped cross section having a back portion and two opposed side portions, said jamb comprising a pair of tracks, each track of said pair of tracks located on a respective side portion and extending in an axial direction substantially parallel to said jamb, said jamb having a pair of opposed channel portions defined by said back portions, respective said two opposed side portions, and respective said pair of tracks;

a sash clip configured to be affixed to a window sash;

a carrier comprising a slidable portion and a window sash support portion, wherein:

said window sash support portion is configured to removably engage said sash clip and further configured to support the window sash; and said slidable portion is configured to slide along said jamb toward upper and lower extremities in the axial direction between said back portion and said opposed side portions; and a locking mechanism comprising a jamb lock located on said jamb and a carrier lock located on said carrier, said jamb lock and carrier lock configured to align with each other by sliding said carrier within said jamb, wherein after said jamb lock and carrier lock are aligned, said locking mechanism is configured to lock said carrier in place along the jamb such that said carrier cannot move toward either the upper or lower extremities.

2. The system according to claim 1, wherein said jamb further comprises:

an aperture located on said jamb where the plurality of tracks are not present, wherein said carrier is insertable into and removable from said aperture in a direction at least one of oblique and perpendicular to the axial direction.

3. The system according to claim 2, wherein said aperture is located proximate the upper extremity of said jamb.

4. The system according to claim 2, wherein said slidable portion comprises:

a first width less than a distance between said two opposed side portions; and a second width greater than a distance between said two opposed side portions, said second width configured to be insertable into and removable from said aperture.

5. The system according to claim 1, wherein said slidable portion comprises:

a first width less than a distance between said two opposed side portions; and a second width greater than a distance between said two opposed side portions.

6. The system according to claim 1, further comprising:

a pair of side guides, each having a generally U-shaped cross section and affixed to a respective opposed edge of said slidable portion of said carrier and configured to slide, together with said carrier, within said channel portion in the axial direction.

7. The system according to claim 1, wherein said jamb lock comprises a plurality of jamb locks arranged in the axial direction.

8. The system according to claim 7, wherein:

said carrier lock comprises a carrier clip; and said plurality of jamb locks comprises a respective plurality of jamb recesses each configured to accept said carrier clip.

9. The system according to claim 7, wherein said carrier lock comprises a carrier aperture and a carrier pin;

said plurality of jamb locks comprises a respective plurality of jamb recesses; and said carrier pin is configured to pass through said carrier aperture to be inserted into a jamb recess of said plurality of jamb recesses.

10. The system according to claim 1, wherein:

said carrier lock comprises a carrier clip; and said jamb lock comprises a jamb recess configured to accept said carrier clip.

11. The system according to claim 1, wherein said carrier lock comprises a carrier aperture and a carrier pin;

said jamb lock comprises a jamb recess; and said carrier pin is configured to pass through said carrier aperture to be inserted into said jamb recess.

12. The system according to claim 1, wherein said carrier lock is located on said slidable portion at a position axially below the window sash, when said window sash support portion supports the window sash.

13. The system according to claim 1, wherein said slidable portion is substantially planar.

14. The system according to claim 1, wherein said carrier is configured to per PTO answer be connected to a window balance.

15. A method of removing a hung window sash from a jamb of a window frame, the jamb having a jamb having a generally U-shaped cross section, the generally U-shaped cross section having a back portion and two opposed side portions, the jamb further having a pair of tracks, each track of the plurality of tracks located on a respective side portion and extending in an axial direction substantially parallel to the jamb, the window having a sash clip affixed to a window sash, the method comprising:

supporting the window sash by a window sash support portion of a carrier engaged with the sash clip;

sliding the carrier via a slidable portion thereof, the slidable portion located between the back portion and the opposed side portions, along the jamb in the axial direction;

aligning a carrier lock located on the carrier with a jamb lock located on the jamb;

locking the carrier against movement toward an upper and lower extremity of the axial direction relative to the jamb, by engaging the carrier lock with the jamb lock;

lifting the window sash substantially in the axial direction to disengage the sash clip from the window sash support portion;

laterally moving the window sash in a direction substantially parallel to a plane defined by the window frame;

pivoting the window sash about an axis substantially parallel to the axial direction; and removing the window sash from the jamb.

16. The method according to claim 15, wherein:

the jamb further comprises an aperture located on the jamb where the plurality of tracks are not present;

the method further comprising at least one of inserting and removing the carrier from the aperture in a direction at least one of oblique and perpendicular to the axial direction.

17. The method according to claim 15, wherein:

the jamb further comprises a pair of generally U-shaped side guides respectively located between the pair of opposed side portions and the back portion; and the method further comprises sliding the carrier by the slidable portion in the pair of generally U-shaped side guides.

18. The method according to claim 15, wherein:

the jamb lock comprises a plurality of jamb locks arranged in the axial direction;

the carrier lock comprises a carrier clip;

the plurality of jamb locks comprises a respective plurality of jamb recesses; and said locking further comprises inserting the carrier clip into one of the plurality of jamb recesses.

19. The method according to claim 15, wherein:

the jamb lock comprises a plurality of jamb locks arranged in the axial direction;

the carrier lock comprises a carrier aperture and a carrier pin;

the plurality of jamb locks comprises a respective plurality of jamb recesses; and said locking further comprises passing the carrier pin through the carrier aperture and into a jamb recess of the plurality of jamb recesses.

20. The method according to claim 15, wherein:

the carrier lock comprises a carrier clip;

the jamb lock comprises a plurality of jamb locks arranged in the axial direction and comprising a respective plurality of jamb recesses; and said locking further comprises inserting the carrier clip into one of the plurality of jamb recesses.

21. The method according to claim 15, wherein the carrier lock comprises a carrier aperture and a carrier pin;

the jamb lock comprises a plurality of jamb locks arranged in the axial direction and comprising a respective plurality of jamb recesses; and said locking further comprises passing the carrier pin through the carrier aperture and into a jamb recess of the plurality of jamb recesses.

22. A method of inserting a hung window into a jamb, the jamb having a jamb having a generally U-shaped cross section, the generally U-shaped cross section having a back portion and two opposed side portions, the jamb further having a pair of tracks, each track of the pair of tracks located on a respective side portion and extending in an axial direction substantially parallel to the jamb, the window having a sash clip affixed to a window sash, the method comprising:

locking the carrier against movement in the axial direction toward the upper and lower extremities, by engaging a carrier lock with a jamb lock;

inserting an edge of the window sash into the jamb, the edge substantially parallel to the axial direction;

pivoting the edge of window sash about an axis substantially parallel to the axial direction until a plane defined by the window sash is substantially parallel with a plane defined by the jamb;

laterally moving the window sash along the plane defined by the window sash;

lowering the window sash substantially in the axial direction to engage the sash clip with a window sash support portion of a carrier; and unlocking the carrier in the axial direction relative to the jamb by disengaging the carrier lock from the jamb lock, such that a slidable portion of the carrier may slide along the jamb in the axial direction, the slidable portion located between the back portion and the opposed side portions.

* * * * *

UNITED STATES PATENT AND TRADEMARK OFFICE

CERTIFICATE OF CORRECTION

PATENT NO. : 7,036,275 B2
APPLICATION NO. : 10/714940
DATED : May 2, 2006
INVENTOR(S) : F. Quesada It is certified that error appears in the above-identified patent and that said Letters Patent is hereby corrected as shown below:

At column 10, line 44 (claim 14, line 2) of the printed patent, after "configured to" delete "per PTO answer".

At column 10, line 47 (claim 15, line 2) of the printed patent, before "generally" delete "jamb having a" (second occurrence).

At column 12, line 13 (claim 22, line 2) of the printed patent, before "generally" delete "jamb having a" (second occurrence).

Signed and Sealed this

Second Day of January, 2007

JON W. DUDAS
*Director of the United States Patent and Trademark Office*